US006044509A

United States Patent [19]

Schrell et al.

[11] Patent Number: 6,044,509

[45] Date of Patent: Apr. 4, 2000

[54] PROCESS FOR CONTINUOUS DYEING OF CELLULOSIC CIRCULAR KNITS WITH WATER-SOLUBLE DYES

[75] Inventors: Andreas Schrell, Kriftel; Ludger Wilbers, Niedernhausen, both of Germany

[73] Assignee: Dystar Textilfarben GmbH & Co Deutschland KG, Germany

[21] Appl. No.: 09/186,835

[22] Filed: Nov. 5, 1998

[30] Foreign Application Priority Data

Nov. 7, 1997 [DE] Germany ..... 197 49 212

[51] Int. Cl.[7] ..... D06B 3/02; D06B 3/28

[52] U.S. Cl. ..... 8/152; 8/151; 68/177

[58] Field of Search ..... 8/151, 152; 68/9, 68/177, 178

[56] References Cited

U.S. PATENT DOCUMENTS 2,764,010 9/1956 Williams ..... 8/151 X 3,927,971 12/1975 Meier-Windhorst ..... 8/152 X 4,077,766 3/1978 Von Der Eltz ..... 8/152 X 4,562,604 1/1986 Damm ..... 8/152 X 5,359,743 11/1994 Von Harten et al. ..... 8/151

*Primary Examiner*—Philip R. Coe

*Attorney, Agent, or Firm*—Connolly Bove Lodge & Hutz

[57] ABSTRACT

Process for continuous dyeing of cellulosic circular knits composed of natural or modified hydroxy-containing or natural, modified or synthetic carboxamido-containing fiber materials with water-soluble dyes comprises initially impregnating the material with an aqueous dye solution, optionally comprising auxiliaries, in the course of the dyeing step, reducing the liquor content to 400% by weight, based on weight of fiber, by squeezing means customary for tubular material, and subsequently subjecting the liquor-comprising material to a leveling and fixing step for the dye applied to the material by transporting the rope of material continuously through the machine unit by means of the flowing dyeing liquor at a liquor ratio of up to 10:1.

10 Claims, 4 Drawing Sheets

PROCESS FOR CONTINUOUS DYEING OF CELLULOSIC CIRCULAR KNITS WITH WATER-SOLUBLE DYES

Continuous processes for dyeing flat fabrics with reactive, direct, vat or disperse dyes by padding methods are established in the art and always provide good results if carried out correctly. Serviceable machinery and standardized dyes ensure a uniform fabric appearance. The situation is different with the dyeing of circular knits. The currently most widely used method for dyeing circular knits is the batchwise exhaust method. Both continuous and semicontinuous methods for dyeing such materials have distinct disadvantages with regard to the appearance of the dyed material. For instance, the semicontinuous dyeing of circular knits with fiber-reactive dyes by the cold pad-batch method gives rise, for example, to crease marks due to the plaiting of the impregnated material in boxes, which greatly reduces the quality of the eventual made-up article. In addition, the fixing times are of the order of hours, making efficient dyehouse management very difficult. Circular knits can also be dyed in a continuous manner by a pad-steam process, but it too has disadvantages as a consequence of creasing, insufficient color yield, nonuniform appearance and two-sidedness. Also, marks due to liquor running back are observed.

Furthermore, U.S. Pat. Nos. 4,351,076 and 4,483,032 disclose wet-processing, especially dyeing, ropes of textile material in jet dyeing apparatus. In this operation, the textile material, which is in rope form on a batchwise or piecewise basis and which is guided past the nozzles, is either set into circulation with the aid of the treatment liquor circulating in the same direction by the nozzle system or is moved on by means of a gas stream or vapor/air mixture being directed at the fiber material from the nozzles under overpressure. The main feature of this processing technique is that the textile material in endless form is conveyed through the machine by the kinetic energy of the tangential jet, it being possible for gas and liquid flow to be alternated or combined during the different treatment stages, which permits a seamless transition from one dyeing step to another without a standstill of the material and under isothermal conditions.

In the discontinuous dyeing method described in U.S. Pat. No. 4,483,032, which is based on the aerodynamic propulsion of the textile rope, the dyeing jet is entered with the fiber material lotwise; in the dyeing jet, the dyeing liquor is applied to the material by injecting it into the circulating gas stream in atomized form, each time giving fresh impetus to the circulation of the textile material and of the treatment liquor not absorbed by the material. The application of the total liquor quantity takes place over a plurality of circulations of the material, and the continuous recirculation of the excess liquor ensures uniform distribution of the liquor not only on but also in the rope and hence excellent levelness of the treatment outcome. When the dyeing operation has ended, the piece-dyed material is removed again from the jet.

According to this reference, the dyeing method it describes can also be carried out continuously, but it does not disclose any technical details for a continuous form. All the directions in this reference concerning practical handling consistently relate to the discontinuous form of the process.

U.S. Pat. No. 4,592,107, however, discloses a process and apparatus for the continuous treatment of ropes of textile material which are in elongate form, i.e., not in endless form, by likewise propelling the textile material by application of the jet principle hydraulically and aerodynamically in alternation. In the course of its passage, the textile rope passes through a series of successive machine units having optionally different objectives, i.e., using selectively different treatment agents or treatment conditions preferably for the wet treatment operation. There is provision here for distinct and diverse treatment stages, clearly separated from one another by rope inlet and rope outlet. Although this operating principle of the multiple impingement of liquid treatment agents on the rope is said to be adaptable to any desired process or processing sequence, it is in fact exclusively employed for washing and cleaning purposes with the goal of improving the so-called dilution factor between two successive wet treatment stages, e.g., the aftertreatment of already dyed fiber material by means of liquor advantageously flowing in the opposite direction to the textile material. The intermediary storing of the moist textile material from a preceding wet treatment mainly has a dewatering purpose so that the effectiveness of the respective treatment operations may be increased. So, this reference neither prevents nor suggests a genuine dyeing process plus dye fixation on a continuous basis.

However, the favorable experience of U.S. Pat. No. 4,483,032 with regard to the propulsion of rope-shaped textiles in jet apparatus by means of a gas stream and also the possible application of treatment agents combined with simultaneous provision of the necessary physical conditions by the gas responsible for propelling the material made it appear possible that this aerodynamic system could also be utilized for fully continuous operation.

Accordingly, U.S. Pat. Nos. 4,885,814 and 4,947,660 describe a process for the continuous dyeing of textile material in rope form by means of jet dyeing machines by effecting the propulsion for the transportation of the material via the kinetic energy of a circulating gas stream by means of a nozzle system. The underlying object was to design the application conditions for the colorant in such a way as to obtain a uniform dyeing in a fully continuous manner using ideally a single, ideally minimal liquor application and ideally under isothermal conditions. In the process, the liquor quantity is determined in such a way that all the liquor applied remains within the rope and no excess, migrating liquor appears even in the course of the subsequent fixation. However, this process is technically not implementable for reactive dyes, since the marks produced during the single, minimal dye application never level out in the further course of the isothermal process described, contrary to the statements in the reference; after all, since the dye solution already contains all the chemicals necessary for fixing reactive dyes, the fixing process starts immediately after the isothermal impregnation. During the further transportation by the gas or gas/vapor mixtures, no further migrating liquor is available for any leveling, and any unlevelness once it has been produced is no longer evened out. Furthermore, during the aerodynamic transportation of the rope by a thermally treated gas, applied dye solution is blown about, which causes local concentration differences and consequent unlevelness on the dyed material. A further disadvantage of this process is that the material is merely plaited down following a nozzle passage and does not float in excess treatment liquor; the material's own weight leads to markings which likewise become irreversibly fixed under the process conditions.

It is an object of the present invention to provide a continuous process for dyeing circular knits composed of natural or modified hydroxy-containing or natural or modified or synthetic carboxamido-containing fiber materials with water-soluble dyes, preferably reactive dyes, without the aforementioned disadvantages, chiefly the formation of crease and runoff marks, and with good fixation of the dye coupled with good penetration.

This object is achieved by the present invention.

The invention accordingly provides a continuous process for dyeing circular knit materials composed of natural or modified hydroxy-containing or natural, modified or synthetic carboxamido-containing fiber materials with water-soluble dyes, which comprises initially impregnating the material with an aqueous dye solution, optionally comprising auxiliaries, in the course of the dyeing step, reducing the liquor content to 400% by weight, based on weight of fiber, preferably to within the range from 150 to 350% by weight, by squeezing means customary for tubular material, preferably by ring- to oval-shaped squeezing means, and subsequently subjecting the liquor-comprising material to a leveling and fixing step for the dye applied to the material by transporting the rope of material continuously through the machine unit by means of the flowing dyeing liquor at a liquor ratio of up to 10:1, such as 6:1 to 10:1, especially 7:1 to 10:1.

The dyeing process is preferably carried out in a jet machine, and the treatment liquors (starting dye solution, a solution to effect dye fixation on the fiber material and a mixture thereof) are preferably applied to the material via venturi or jet nozzles (hereinbelow referred to for simplicity as "jet nozzles"), the treatment liquors transporting the material through the dyeing apparatus via the jet nozzles.

In the dyeing process of the present invention, the rope of textile material is initially impregnated with the aqueous dye solution in a very short liquor, approximating a padding step; the subsequent leveling and fixing step corresponds to the methods of exhaust dyeing in a medium liquor ratio in the manner defining the invention, so that a dye solution, once it has been applied, is able to migrate and fix level on the textile tube material with the dye detaching from the fiber only to an extremely small extent, if at all. The process of the present invention additionally has the advantage of making it possible to reduce significantly the amounts of electrolyte salt which are customary for the application of water-soluble, especially anionic, dyes and of the alkali required to fix reactive dyes on the fiber.

Hydroxy-containing fiber materials are for example cellulosic fiber materials, such as the natural fiber materials, like cotton, jute and linen, and the modified fiber materials produced from cellulosic natural materials, like regenerated cellulose, for example filament viscose rayon, and cellulose fibers modified with amino-containing compounds, as are known for example from U.S. Pat. Nos. 5,507,840, containing compounds, as are known for example from U.S. Pat. Nos. 5,507,840, 5,565,007 and 5,529,585, from European patent application publication No. 0 665 311 and from German Offenlegungsschrift 19 519 023. Carboxamido-containing fiber materials are natural fiber materials, such as wool and other animal hairs, and also silk, and synthetic polyamide fiber materials, such as fiber materials composed of nylon-6, nylon-11 and nylon-6,6.

Dyes which can be used in the dyeing process of the present invention include all water-soluble dyes, especially those which are anionic in nature. Dyes having anionic, i.e., acidic, water-solubilizing groups are for example acid and direct dyes, e.g., C.I. Acid Black 27 (C.I. No. 26 310), C.I. Acid Black 35 (C.I. No. 26 320), C.I. Acid Blue 113 (C.I. No. 26 360), C.I. Direct Orange 49 (C.I. No. 29 050), C.I. Direct Orange 69 (C.I. No. 29 055), C.I. Direct Yellow 34 (C.I. No. 29 060), C.I. Direct Red 79 (C.I. No. 29 065), C.I. Direct Yellow 67 (C.I. No. 29 080), C.I. Direct Brown 126 (C.I. No. 29 085), C.I. Direct Red 84 (C.I. No. 35 760), C.I. Direct Red 80 (C.I. No. 35 780), C.I. Direct Red 194 (C.I. No. 35 785), C.I. Direct Red 81 (C.I. No. 28 160), C.I. Direct Red 32 (C.I. No. 35 790), C.I. Direct Blue 162 (C.I. No. 35 770), C.I. Direct Blue 159 (C.I. No. 35 775), C.I. Direct Black 162:1 and C.I. Direct Violet 9 (C.I. No. 27 885). Further dyes whose use is suitable for the process of the present invention are sulfur dyes or vat dyes in their water-soluble form.

However, the process of the present invention is particularly useful for dyeing with fiber-reactive dyes. As fiber-reactive dyes may be mentioned in particular those where the fiber-reactive radical is a radical of the vinyl sulfone series, for example vinylsulfonyl or an ethylsulfonyl group which is substituted by an alkali-eliminable substituent in the β-position, such as β-sulfatoethylsulfonyl, β-acetoxyethylsulfonyl, β-chloroethylsulfonyl or β-thiosulfatoethylsulfonyl, also fiber-reactive radicals of the chlorotriazinyl, fluorotriazinyl, fluoropyrimidinyl and chlorofluoropyrimidinyl series, and also dyes possessing combinations of such reactive groups.

The abovementioned dyes useful for the dyeing process of the present invention are extensively described in the literature and well known to the person of ordinary skill in the art; fiber-reactive dyes are described for example in the patent specifications mentioned at the beginning and also in European patent application publication No. 0 513 656.

The dyeing process of the present invention can be used for treating all customary circular knit articles, such as single jersey, loop plush, interlock, fine rib, piquet and lining or trainer fabrics.

The dye solution with which the tubular material is impregnated at a very short liquor ratio may, as mentioned, comprise auxiliaries, for example buffer substances, wetting agents, crease-mark inhibitors, leveling aids, migrating aids and, if necessary, dye solubility enhancers, further the synthesis-based electrolyte salts customary in the case of water-soluble dyes, such as sodium sulfate, sodium chloride, lithium chloride and potassium chloride. The starting dye solution comprises the dye in the amount required for the particular depth of shade, for example in an amount of up to 150 g per liter.

The process of the present invention can be carried out not only according to the cocurrent principle, whereby the textile material and the dyeing and fixation liquors or treatment liquors move in the same direction, but also according to the countercurrent principle, whereby the dyeing and fixing liquors or treatment liquors move through the chambers in the opposite direction to the textile material.

In both cases, the fixing step is carried out under the conditions which are customary for the particular choice of dye and for the particular choice of fiber material, such as dyeing temperature and addition of suitable fixing aids and of any other auxiliaries required, as extensively described in the literature, and well-known to the person of ordinary skill in the art, for the particular dyes and fiber materials. For instance, fiber-reactive dyes in particular are fixed on the fiber material, especially on cellulosic fiber material, using an alkaline aqueous fixing liquor comprising per liter up to 50 g of electrolyte salt such as sodium chloride, potassium chloride and/or sodium sulfate, and up to 30 g of an alkaline agent, such as sodium carbonate or sodium hydroxide. Reactive dyes are preferably fixed using an aqueous alkaline fixing solution comprising per liter 10 to 30 g of sodium sulfate and 10 to 30 g of sodium carbonate.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

Figure 1A:
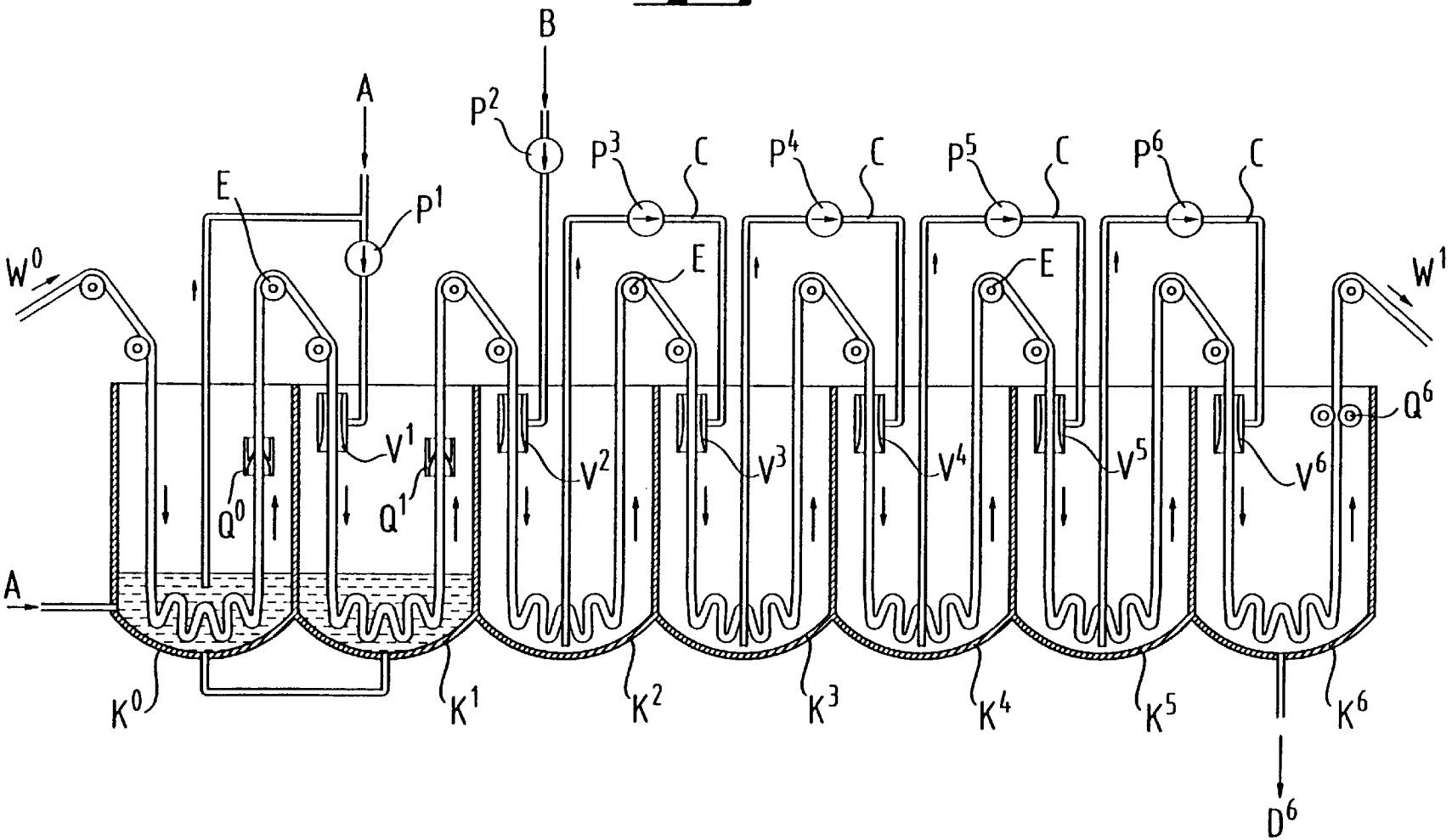
FIG. 1*a* is a diagrammatic view illustrating the dyeing process and apparatus of the present invention carried out according to the cocurrent principle.
Figure 2:
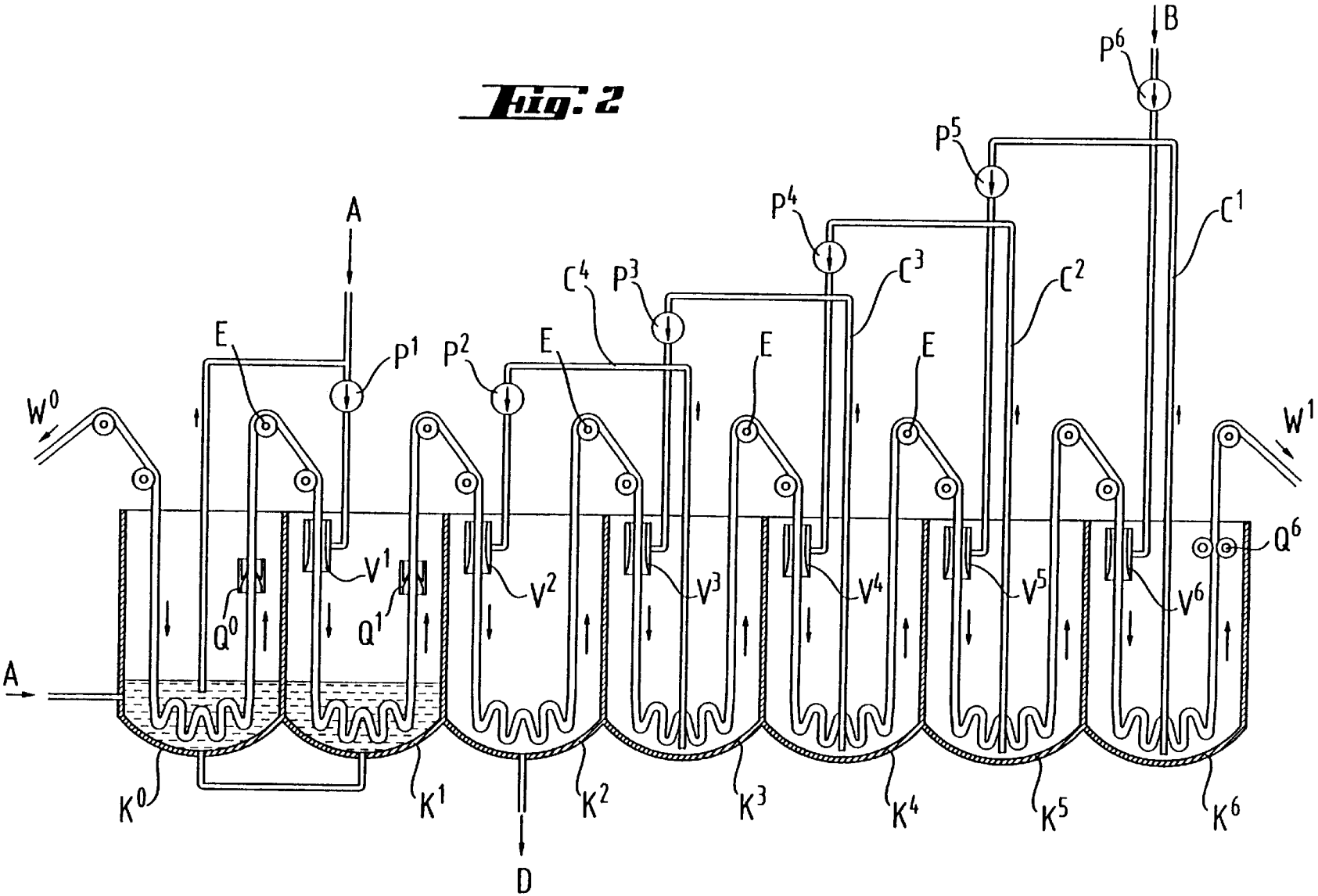
FIG. 2 is a diagrammatic view illustrating the dyeing process and apparatus of the present invention carried out according to the countercurrent principle.
Figure 3:
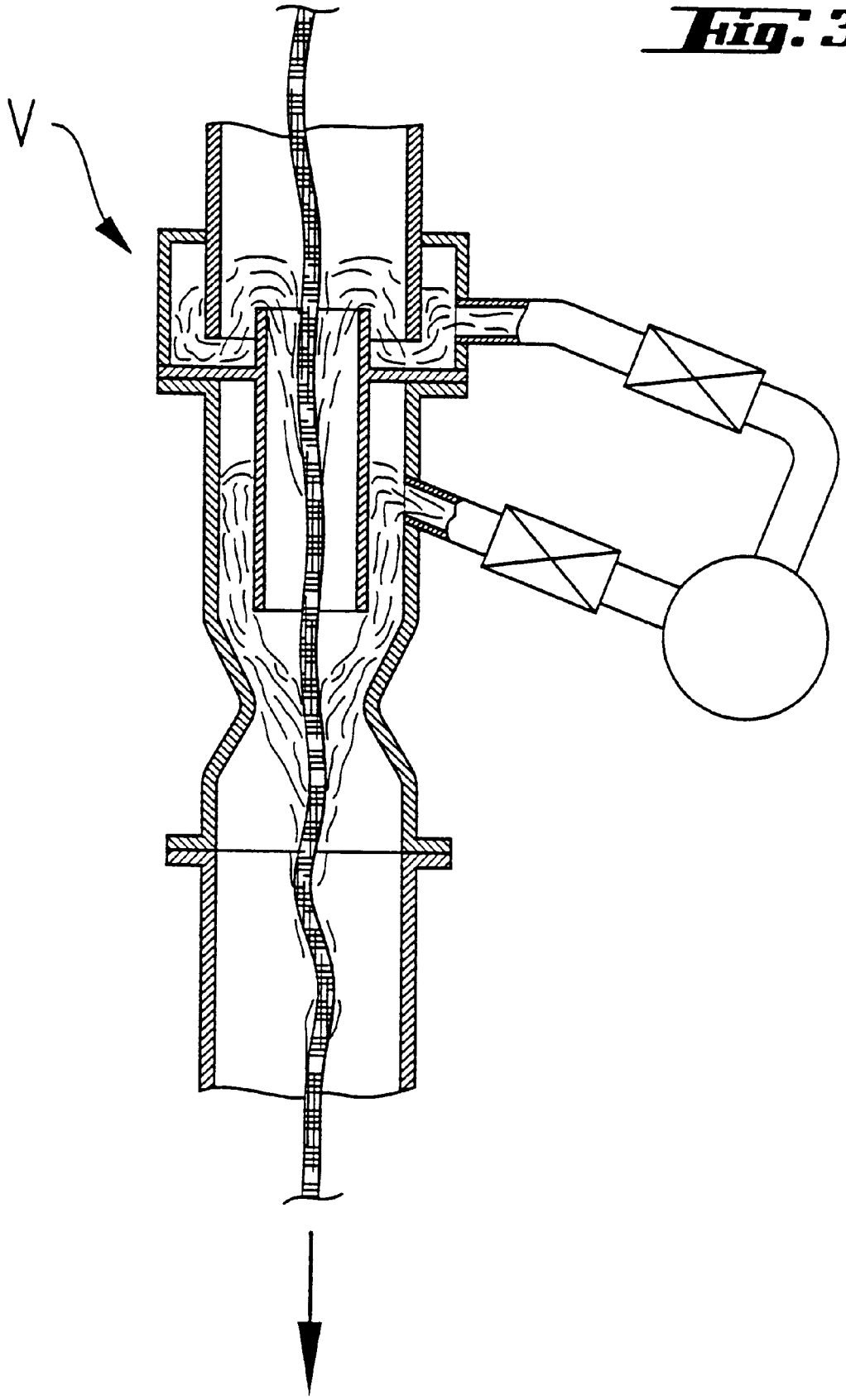
FIG. 3 is an enlarged sectional view of one of the jet nozzles.

In what follows, the principle of the two procedures is illustrated by FIGS. 1*a* and 2; their reference characters have the following meanings:

| | |
|---|---|
| $W^0$ = tubular material to be dyed | $W^1$ = dyed tubular material |
| A = aqueous dye solution | B = aqueous fixing solution |
| C = the dye solution (dyeing liquor) comprising fixing agent B | |
| D = liquor outlet | E = cloth redirector |
| Q = squeeze means | P = pump for treatment liquor |
| V = jet nozzle | |
| $K^0$ and $K^1$ = impregnating chambers with dye solution A | |
| $K^2$ to $K^6$ = dwell chambers | |

The principle of the continuous procedure in cocurrent form is hereinbelow illustrated with reference to FIG. 1*a:*

The material $W^0$ passes as an endless circular knit tube through the dyeing apparatus of FIG. 1*a,* which, via chamber $K^6$, is connected to a washing apparatus for the dyed material $W^1$. Apparatus part $K^1$ to $K^6$ illustrates the principle of a jet dyeing machine. The tubular material passes through jet nozzles ($V^1$ to $V^6$) and is transported through the apparatus by means of treatment liquors (A, B and C) which are driven through the jet nozzles by pumps P; it moves at high speed (within the range from 30 to 60 m/min) and, between the individual nozzle passages, is plaited down in layers in the chambers ($K^0$ and $K^1$ to $K^6$) in which it continues to move slowly within about 5 to 10 minutes. The material $W^0$ entering $K^0$ is treated with the dye solution in $K^0$ and $K^1$, passage through $V^1$ ensuring complete impregnation. $K^0$ and $K^1$ communicate with each other, whether by overflow or a line, so that A can flow back from $K^1$ to $K^0$ . The material impregnated with A in $K^0$ may, if appropriate, pass into $K^1$ by passing through a customary squeeze means ($Q^0$), for tubular material, for example a ring-shaped rubber lip, to reduce the liquor content. As the impregnated material transfers from $K^1$ to $K^2$ the liquor content of the material reduces to about 150 to 400% by weight, on weight of fiber, due to a customary squeeze means ($Q^1$) for tubular material. Jet nozzle $V^2$ then presses the fixing liquor B into the material containing the dye solution A (if the leuco form of vat dyes is used, B can be a solution containing an oxidizing agent; if fiber-reactive dyes are used, it can be an aqueous solution containing an alkaline agent). The liquor present in $K^2$ and formed of A and B is pumped by $P^3$ from $K^2$ via $V^3$ to $K^3$; the same operation repeats from $K^3$ to $K^4$, from $K^4$ to $K^5$ and from $K^5$ to $K^6$. In this way, the tubular material is intensively repeatedly impregnated with the dyeing liquor C, which is maintained at the necessary treatment temperature in all regions, and is able to dwell in the individual chambers $K^2$ to $K^6$ for a sufficient time to fix the dye on the fiber (or to form and fix the dye in the case of vat dyes). Spent liquor C can be removed from the dyeing apparatus through discharge $D^6$. The dyed material $W^1$, on which the dye has become fixed, is—while still saturated with liquor C—freed from liquor C as much as possible via squeeze means $Q^6$ and then passed into a customary rope washer downstream of this jet machine, it being possible for the material to be transported, similarly to the jet dyeing machine, via jet nozzles through which the aftertreatment liquors (such as water at various temperatures, aqueous alkali-neutralizing solutions, aqueous detergent solutions).

Figure 1B:
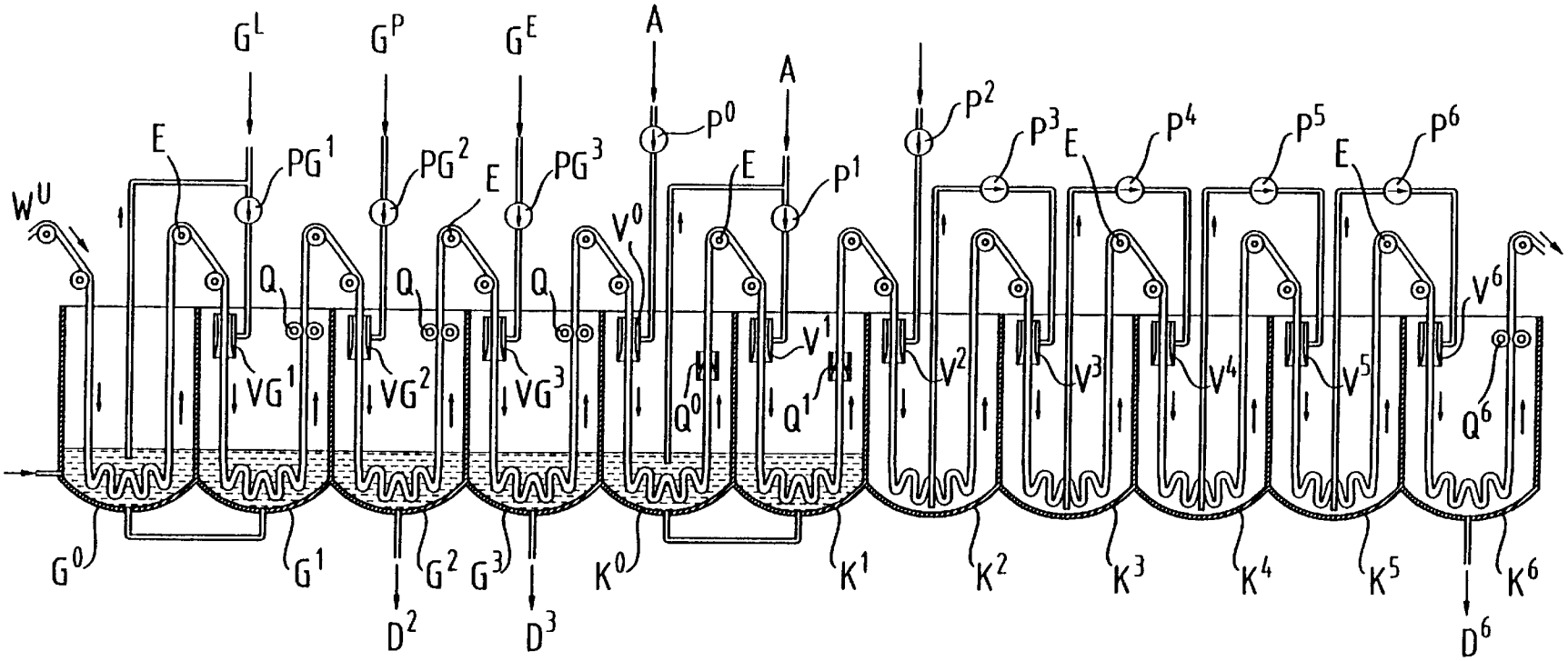
FIG. 1*b* is a diagrammatic view illustrating the process and apparatus of the present invention where the dyeing apparatus of FIG. 1*a* is connected to upstream apparatus operated by jet nozzles.

FIG. 1*b* illustrates the principle of an apparatus where the dyeing apparatus of FIG. 1*a* is connected to an upstream apparatus which is operated by means of jet nozzles in a similar manner to the jet dyeing machine. This upstream apparatus with the chambers $G^0$, $G^1$, $G^2$ and $G^3$ is used for bleaching raw cotton circular knit material which, after the bleaching step, can be fed directly into the dyeing apparatus (as per FIG. 1*a*). Similarly to chambers $K^0$ and $K^1$, the material is impregnated with the bleaching solution in chambers $G^0$ and $G^1$, which communicate with each other, and the unbleached raw material ($W^U$) is bleached or aftertreated via the jet nozzles $V^{G1}$, $V^{G2}$, $V^{G3}$ with the various treatment liquors (such as bleaching solution $G^L$, a peroxide-reducing solution $G^P$ and an acetic acid solution $G^E$ which neutralizes the material). Between each treatment step in the individual chambers $G^1$ or $G^2$ or $G^3$, the material saturated with the corresponding treatment liquor and passing from one chamber to the other has the treatment liquor removed from it as intensively as possible by squeeze means Q. The bleached material emerging from $G^3$ is then introduced into the impregnating chamber $K^0$, which holds dye solution A, and the subsequent dyeing step can then proceed similarly to the description for FIG. 1*a.*

The principle of the dyeing process employing the principle of countercurrent treatment, whereby the treatment liquor (dyeing liquor C) flows in the opposite direction to the material to be dyed, is to be illustrated with reference to FIG. 2:

As in the process of FIG. 1*a,* the material is initially impregnated with dye solution A in impregnating chambers $K^0$ and $K^1$ and after reduction of the liquor content of the material to about 150 to 400% by weight, on weight of fiber, by a squeeze means ($Q^1$) customary for tubular material introduced into chamber $K^2$ via jet nozzle $V^2$. In accordance with the countercurrent principle, the treatment liquor C (such as a dye solution which contains electrolyte salt and has an alkaline action in the case of reactive dyes) is transferred by a pump ($P^5$) from the last chamber ($K^6$) of the dyeing machine into the preceding chamber ($K^5$) and in the course of the transfer applied via a jet nozzle ($V^5$) to the tubular material passing through this jet nozzle. The agent required for fixing the dyes, such as an alkaline agent in the case of fiber-reactive dyes, is continuously forced in the form of treatment liquor B into chamber $K^6$ and onto the tubular material via jet nozzle $V^6$, the liquor B mixing in $K^6$ with the dyeing liquor entrained by the tubular material from $K^2$ to $K^6$ to form the liquor $C^1$ (which, as the material exits from $K^6$, is squeezed off by means of $Q^6$ as much as possible and returns into $K^6$). Liquor $C^1$, which is rich in fixing agent B, fixes remaining, unfixed dye portions.

Similarly to the transfer of liquor $C^1$ from $K^6$ to $K^5$, the liquor C transfers in further steps into whichever is the preceding chamber K (as from $K^5$ to $K^4$ etc.) in order to be pressed via the corresponding jet nozzles onto the tubular material and to be able to dwell in the respective chamber to fix the dye. In this way, the tubular material coming from whichever is the preceding chamber is already impregnated with the dye solution A containing the fixing agent B (equal to treatment liquor C), and the particular treatment liquor C in the preceding dyeing chamber (dwell chamber), for example $C^3$, has—as a consequence to the contrary movement of the liquor C to the textile material—a somewhat higher dye content and a lower B content than in the subsequent dyeing chamber, for example $C^4$. This operation is repeated a number of times. $K^2$ is the final destination of a treatment liquor ($C^4$) having only a minimum amount of fixing agent B left, which can be discharged via D from $K^2$.

The gradual decrease in the level of fixing agent B (such as the alkaline agent when fiber-reactive dyes are used) in the liquors C on going from $C^1$ to $C^4$ and, conversely, the gradual increase in the level of B on the tubular material during transportation through chambers $K^2$ to $K^6$ bring about even, uniform fixing of the dye applied to the tubular material during the dwell time in the chambers of 30 to 60 minutes in total.

Each of the treatment liquors, whether in the cocurrent procedure of FIGS. 1 or according to the countercurrent procedure of FIG. 2, is maintained in the particular chambers K at the temperature necessary for the particular treatment.

The Examples hereinbelow illustrate the invention. Parts and percentages are by weight, unless otherwise stated. Parts by weight relate to parts by volume as the kilogram relates to the liter.

EXAMPLE 1

To dye a bleached cotton tricot in tubular form, having a weight of about 240 g/m$^2$, in a continuous apparatus, the material is transported as an endless tube through the dyeing apparatus (see FIG. 1*a*) at a speed of 40 m/min by means of jet nozzles driven by the treatment liquor. The material to be dyed ($W^0$) is initially impregnated in an impregnating chamber ($K^0$) with an aqueous hot dyeing liquor (A) at 60° C. comprising per liter 5 g of C.I. Reactive Yellow 027, 5 g of C.I. Reactive Red 242, 16 g of C.I. Reactive Black 5, 25 g of anhydrous sodium sulfate, 2 g of a commercially available crease-mark inhibitor and about 2 g of a commercially available wetting agent. The saturated material, which may optionally be reduced to a liquor content of 300%, on the weight of fiber, via customary squeeze means for tubular material, such as a ring-shaped rubber lip, is conveyed by a jet nozzle ($V^1$), which is driven by means of the same dye liquor (A), into the dyeing apparatus' chamber $K^1$ which is connected to $K^0$. The material is, as in chamber $K^0$, plaited down in the dyeing liquor present in chamber $K^1$, at the same liquor ratio, in the form of tubular folds which slowly move to the other side of chamber $K^1$ and thus dwell for about 8 minutes in the dyeing liquor. The material saturated with A is thereafter reduced by (further) squeeze means ($Q^1$) to a liquor content of 300%, on the weight of fiber, and transported by means of a solution B into chamber $K^2$ of the dyeing apparatus via a further jet nozzle ($V^2$). Solution B consists of a hot aqueous alkaline solution at 60° C. comprising per liter 30 g of anhydrous sodium sulfate and 20 g of anhydrous sodium carbonate. The material impregnated with the dye solution and now additionally with the alkaline solution B then passes, plaited down into tubular folds, through chamber $K^2$ and slowly moves in the course of about 8 minutes to the other part of chamber $K^2$. The liquor ratio of dyeing liquor C then present on the material is about 8 parts by weight of liquor to 1 part by weight of material. On exiting from chamber $K^2$, the material saturated with dyeing liquor C is transferred, by means of dye liquor C, via a further jet nozzle ($V^3$) into chamber $K^3$ to dwell therein in the same way. This process repeats to transfer the material respectively into chambers $K^4$, $K^5$ and $K^6$ as the tubular material in a particular preceding chamber, in which it dwells at the same liquor ratio of about 8:1, is driven by the excess dyeing liquor C from this preceding chamber or running off the material via a jet nozzle into the next chamber, the dyeing liquor being in each case contained at a temperature of 60° C. On leaving the chamber $K^6$, the dyed tubular material ($W^1$), on which the dyes have been fixed, is squeezed to remove the spent dyeing liquor C therefrom as far as possible, and fed to a customary washer, which can be equipped with chambers similarly to the apparatus of FIG. 1*a,* in which case the material is washed and aftertreated with water and the customary aftertreatment liquors, which can drive the tubular material via jet nozzles.

A black dyeing is obtained with similar fastness properties and depth of shade as obtained in a batchwise dyeing operation utilizing the same dyeing conditions.

EXAMPLE 1A

The dyeing operation described in Example 1 can also be integrated with a preceding bleaching operation on the starting raw material, provided this starting raw material consists of unbleached cotton. To this end, a raw cotton tricot in tubular form, weighing about 240 g/m$^2$, is passed at a speed of 40 m/min through the continuous apparatus (FIG. 1*b*), consisting of the dyeing apparatus illustrated in FIG. 1*a* and the preceding bleaching apparatus comprising the chambers $G^0$, $G^1$, $G^2$ and $G^3$. The raw material ($W^U$) is initially treated in chamber $G^0$ with a hot bleaching solution ($G^L$) at 80° C., the material, similarly to the description in Example 1 for the chambers $K^0$ and $K^1$ to $K^6$, slowly moving in the form of tube folds through the chamber $G^0$ over a dwell time of about 8 minutes and, after leaving $G^0$, being transported into the chamber $G^1$ by the same bleaching solution $G^L$ via the jet nozzle $V^{G1}$ (the aqueous bleaching solution $G^L$ comprises per liter 10 ml of aqueous 33% strength sodium hydroxide solution and 10 ml of aqueous 35% strength hydrogen peroxide solution). In chamber $G^1$, the material dwells again for about eight minutes in similar fashion (the chambers $G^0$ and $G^1$ communicate similarly to the chambers $K^0$ and $K^1$ in FIG. 1*a,* so that excess solution can run from $G^1$ to $G^0$); the material thus saturated is squeezed off to a very low liquor content via typical squeeze means (Q) for tubular material and is then transported, via a further jet nozzle ($V^{G2}$) into the next chamber $G^2$ by means of a hot aqueous solution $G^P$ at 80° C. comprising per liter 1.5 ml of a commercially available peroxide-reducing agent. Following a dwell time in chamber ($G^2$) of about eight minutes, the material is squeezed by squeeze means (Q) to remove solution $G^P$ as completely as possible, and driven by an aqueous acetic acid solution ($G^E$) (comprising 1 ml of 60% strength acetic acid per liter) via a further jet nozzle ($V^{G3}$) into the chamber $G^3$. Following a dwell time of about eight minutes, while the material, as in the preceding chambers, slowly moves, plaited down in tubular folds, in solution $G^E$ in chamber $G^3$, it is squeezed to remove the acetic acid solution as completely as possible, and then transferred into chamber $K^0$, which has been charged with an aqueous dye solution A consisting of 10 g of C.I. Reactive Yellow 027, 10 g of C.I. Reactive Red 242, 32 g of C.I. Reactive Black 5, 25 g of anhydrous sodium sulfate, 2 g of a commercially available crease-mark inhibitor and 2 to 3 g of a commercially available wetting agent. Preferably, the tubular material can be transported into chamber $K^0$ in the same way as for the transfer from $K^0$ to $K^1$, via a jet nozzle driven by dyeing liquor A. In $K^0$ it remains in the dye solution A for a dwell time of about eight minutes. The tubular material saturated with dye solution A can be reduced to an A content of 300%, on weight of fiber, by customary squeeze means ($Q^0$) for tubular material before transfer into the chamber $K^1$. The tubular material is then transferred by means of dyeing liquor A, via jet nozzle $V^1$, into chamber $K^1$ and then, following a dwell time of about eight minutes in solution A at the same liquor ratio as in $K^0$, transported via squeeze means $Q^1$ by means of an alkaline aqueous solution B, as described in Example 1, into chamber $K^2$ via jet nozzle $V^2$. The rest of the dyeing operation then proceeds as described in Example 1, the material being transported by the alkaline dyeing liquor C, via the various jet nozzles, into the various chambers, through each of which it passes in the course of a dwell time of about eight minutes, while the dyes become fixed on the tubular material. The dyed material $W^1$ then leaves the chamber $K^6$ to be washed and aftertreated in a conventional manner in an attached washer.

A deep black dyeing is obtained with the same fastness properties as a dyeing prepared in a batchwise process utilizing the same dyeing conditions.

EXAMPLE 3

To dye mercerized cotton jersey in tubular form, having a weight of about 220 g/m$^2$, an endless tube of the material is passed at a speed of 50 m/min through a continuous dyeing machine (as per FIG. 2), the tube of material, as already described in Examples 1 and 1A, being propelled by below-described treatment liquors via jet nozzles.

The tubular material ($W^o$) initially passes, plaited down into tubular folds, through a chamber ($K^0$) filled with an aqueous hot dye solution A at 60° C. comprising per liter 30 g of C.I. Reactive Yellow 027, 30 g of C.I. Reactive Red 159, 30 g of C.I. Reactive Blue 182, 70 g of anhydrous sodium sulfate, 2 g of a commercially available crease-mark inhibitor and about 2 g of a commercially available wetting agent. The material is saturated with the solution A in $K^0$ and, optionally after the liquor content has been reduced to about 300%, on the weight of fiber, by customary tube squeeze means, driven via a jet nozzle ($V^1$) into chamber $K^1$ (the chambers $K^0$ and $K^1$ communicate, so that excess dye solution can run back from $K^1$ into $K^0$) by the dye solution A of the same composition. In the dye solution maintained at 60° C., the plaited tubular material passes through chamber $K^1$ at the same liquor ratio in the course of a dwell time of about eight minutes. The impregnated material is reduced by squeeze means $Q^1$, such as a ring-shaped rubber lip, to a dye solution content of about 300% and then, via a jet nozzle ($V^2$), transported into the next chamber ($K^2$) by the dyeing liquor $C^4$. This dyeing liquor $C^4$ consists of the essentially already spent alkaline dye solution of A, which moves countercurrently to the tubular material and gets, out of the attached chambers, from $K^5$ to $K^4$ and further to $K^3$ and in turn removed from $K^3$by means of $V^2$ to $K^2$. The alkaline dye solution (alkaline dyeing liquor C) forms in the last chamber of the dyeing operation ($K^6$) when an aqueous alkaline electrolyte salt solution (B) is pressed via a jet nozzle ($V^6$) onto the tubular material which has been impregnated with the alkaline dye solution A already present in the preceding chambers $K^2$ to $K^6$, and the dyes are already essentially fixed on the material. This hot solution B at 60° C. comprises 30 g of anhydrous sodium sulfate and 20 g of anhydrous sodium carbonate per liter. In chamber $K^6$, the resulting strongly alkaline solution ($C^1$) having but a minimal dye content (if any dye is left over at all) moves the tubular material therethrough in the course of a dwell time of about eight minutes for final fixation of the dyes, and the tubular material is then squeezed by squeeze means ($Q^6$) to remove the dyeing liquor as completely as possible from the tubular material impregnated with ($C^1$) and passes on to a conventional washer as already described in Example 1.

The alkaline dyeing liquor ($C^1$) formed in $K^6$ is continuously removed from this chamber by a pump and pressed via a jet nozzle ($V^5$) onto the tubular material entering chamber $K^5$ from chamber $K^4$, the tubular material being transported by the flow pressure of liquor $C^1$ and the tubular material slowly moving through the chamber $K^5$ in the course of a dwell time of about 8 minutes. This process repeats a number of times as the alkaline dyeing liquor ($C^2$), in which the alkali is gradually consumed, is forced from $K^5$ via the jet nozzle $V^4$ onto the tubular material toward $K^4$, the liquors each being maintained at a temperature of 60° C. and the ratio of liquor to material being in each case about 8:1.

The gradual decrease in the alkali content of liquors C on the way from $C^1$ to $C^4$ and, conversely, the gradual increase in the alkali content on the tubular material during transportation through chambers $K^2$ to $K^3$ to $K^4$, etc., bring about an even, uniform fixation of the dyes applied to the tubular material during a dwell time in the chambers $K^2$ to $K^6$ of 40 minutes in total.

The tubular material obtained following completion of the dyeing process and the aftertreatment of the resulting dyeing ($W^1$) in the adjoining washer has an aubergine color and the same fastness properties and the same depth of shade as a dyeing obtained in a batchwise procedure utilizing the same conditions.

What is claimed is:

1. A continuous process for dyeing circular knit materials composed of natural or modified hydroxy-containing or natural, modified or synthetic carboxamide-containing fiber materials with water-soluble dyes, which comprises initially impregnating the material with an aqueous dye solution, reducing the liquor content in the course of impregnating the material with the aqueous dye solution to 400% by weight, based on weight of fiber, by squeezing means, and subsequently subjecting the liquor-containing material to a leveling and fixing step for the dye applied to the material by transporting the material continuously through the the aqueous dye solution by means of a flowing dyeing liquor at a liquor ratio of up to 10:1.

2. A process as claimed in claim 1, wherein the liquor content of the material after its impregnation with the dye solution is reduced to 150 to 350% based on weight of fiber.

3. A process as claimed in claim 1, wherein the leveling and fixing step is effected at a liquor ratio of 6:1 to 10:1.

4. A process as claimed in claim 1, performed in a jet dyeing machine.

5. A process as claimed in claim 1, wherein the material moves cocurrently with the treatment liquors.

6. A process as claimed in claim 1, wherein the treatment liquor moves countercurrently to the material.

7. A process as claimed in claim 1, wherein a reactive dye is used in the dyeing step.

8. A process as claimed in claim 1, wherein the material to be dyed consists of cellulosic fiber material.

9. A process as claimed in claim 1, wherein the treatment liquors are applied to the material via jet nozzles and the treatment liquors transport the material through the dyeing apparatus via said jet nozzles.

10. A process as claimed in claim 1, wherein the material in the treatment step is plaited down in the treatment liquors in individual chambers of a dyeing apparatus and passes through the chambers in the plaited down form.

* * * * *